US008672026B2

(12) United States Patent
van Zuilekom et al.

(10) Patent No.: US 8,672,026 B2
(45) Date of Patent: Mar. 18, 2014

(54) FLUID CONTROL IN RESERVIOR FLUID SAMPLING TOOLS

(75) Inventors: Anthony Herman van Zuilekom, Houston, TX (US); Michael T. Pelletier, Houston, TX (US); Li Gao, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 683 days.

(21) Appl. No.: 12/842,377

(22) Filed: Jul. 23, 2010

(65) Prior Publication Data

US 2012/0018152 A1 Jan. 26, 2012

(51) Int. Cl.
*E21B 49/08* (2006.01)

(52) U.S. Cl.
USPC ..... 166/264; 166/68; 417/313

(58) Field of Classification Search
USPC ..... 166/264, 68; 417/313
See application file for complete search history.

(56) References Cited

U.S. PATENT DOCUMENTS

| | | | | |
|---|---|---|---|---|
| 5,377,755 | A * | 1/1995 | Michaels et al. | 166/264 |
| 5,635,631 | A * | 6/1997 | Yesudas et al. | 73/61.46 |
| 5,741,962 | A * | 4/1998 | Birchak et al. | 73/152.16 |
| 5,799,733 | A | 9/1998 | Ringgenberg et al. | |
| 6,334,489 | B1 | 1/2002 | Shwe et al. | |
| 2001/0050170 | A1 | 12/2001 | Woie et al. | |
| 2009/0260798 | A1 * | 10/2009 | Brennan et al. | 166/66.6 |
| 2010/0132941 | A1 | 6/2010 | van Zuilekom et al. | |

FOREIGN PATENT DOCUMENTS

| | | | |
|---|---|---|---|
| GB | 2345137 | A | 6/2000 |
| WO | WO-0220944 | A1 | 3/2002 |

* cited by examiner

*Primary Examiner* — Shane Bomar
*Assistant Examiner* — Robert E Fuller
(74) *Attorney, Agent, or Firm* — Patton Boggs LLP

(57) ABSTRACT

A pumping system comprising: a probe to suction a fluid from a fluid reservoir; a pump in fluid communication with said probe; a sensor for detecting phase changes in said pumping system, said sensor in fluid communication with said probe or pump, said sensor generating a sensor signal; a fluid exit from said pumping system, said fluid exit being in fluid communication with said pump; and a variable force check valve located between said probe and said fluid exit.

8 Claims, 8 Drawing Sheets

FLUID CONTROL IN RESERVIOR FLUID SAMPLING TOOLS

BACKGROUND OF THE INVENTION

1. Field of the Invention

This invention relates in general to oil and gas reservoir technology, and more particularly to apparatus and methods for controlling the fluid phase in sampling and other pumping operations.

2. Background of the Invention

During drilling, pumping, and similar operations in reservoirs, such as oil and gas reservoirs, it is often useful to test or sample the reservoir fluid. In such testing or sampling, many problems can arise. It is important that the fluid tested or the sample retrieved is representative of the reservoir fluid. Further, information concerning many properties of the fluid must be obtained, and determination of one property may interfere with determination of another property. The various factors of importance in testing and sampling are often interrelated such that improving one factor degrades another. For example, operations such as drilling and pumping often need to be suspended during the testing and/or the properties need to be determined as close as possible to real time. However, wells are often deep, which increases the time and difficulty of making tests and taking samples. For sampling and testing while drilling, the drilling operation has to stop briefly so that sampling and testing can be carried out. It is highly desirable to reduce such stoppage. These factors often lead to maximizing the pumping speed to save time and related costs. However, the faster the pumping speed, the more likely that the phase of the fluid will change at some point along the pump path. FIG. 3 shows a well-known pressure-temperature (P-T) phase diagram. $P_1$ indicates formation pressure, and $P_2$ indicates pressure inside the pump. Assuming the change in fluid temperature to be negligible, $P_1$ and $P_2$ are on an isotherm, indicated by the arrow connecting $P_1$ and $P_2$. $P_2$ has to be less than $P_1$ for fluid to flow. In the region 77, the fluid is a liquid, while in the region 78, at least some of the liquid has changed to a gas. To maintain single phase, $P_2$ has to be greater than the dew point line 79. However, if attention is only paid to maintaining efficient pumping speed, vapor can form in the system, in which case the test or sample is not representative of the reservoir fluid. In particular, bubbles begin to form at a temperature-pressure given by the bubble point line 80. On the other hand, slowing or stopping the pumping can result in contamination encroachment into the sample zone, which reduces the accuracy of the results and leads to even longer testing and sampling times. Thus, fluid control during drilling, pumping, and other reservoir operations can be difficult.

FIGS. 1 and 2 illustrate the difficulty of controlling fluid in a state-of-the-art downhole fluid sampling tool. FIG. 1 shows a display of a fluid control computer, such as shown at 284 in FIG. 5. Starting from left to right, the first track 12 shows the "formation pressure" (FPRE) at curve 15, which is the pressure as the fluid enters the tool. The text, such as 14, in track one shows the value of the formation pressure in psi (pounds per square inch). The second track 16 records Pump Performance, while the third track 18 displays Efficiency (not shown in the figure) and Time of Day. The fourth track 20 gives Pump Rate in cc/sec (cubic centimeters per second), and Raw Density is shown in the fifth track 23 (Fluid Density) at curve 22. The sixth track 26 is a volumetric bin display where the shadings indicate a range of fluid density in 0.1 g/cc ranges from 0.3 to 1.3 g/cc with the volume in percentage from left to right. This particular screen 10 shows a typical phase change that takes place in the pump as the pressure goes below the bubble point of the oil. The FPRE plot 14 shows FPRE going in steps from 1957 at 15:33 to a lower but varying pressure of 1300 to 1500 psi from 15:37 to 15:49. As the fluid cleans up from filtrate including contamination to formation oil, the density becomes more variable; and the Bin Display of track 26 shows some low volume gas and a change in three different fluid densities expelled from the pump, which fluid densities can be seen by the different shadings. In the actual display, these densities are shown in color, but because patent drawings do not yet allow color, the different densities are designated by different shading. The single phase is indicated by the shading at 33. The shading at 28 indicates one multi-phase density, the shading at 31 indicates another, and the shading at 32 indicates a third multi-phase density. At a high pump speed of 12 ccps, the formation pressure is low, for example, as at 14, and the density varies rapidly between different multiple phase densities. When the rate is reduced, the density goes back to a single phase as the FPRE pressure increases to 2102 psi. FIG. 2 shows a Bubble Point plot 50 of pressure versus pre-test fractional volume of the fluid sampled in the example of FIG. 1. As known in the art, the bubble point plot is generated downhole by decompressing the fluid in a pretest chamber and measuring the volume versus pressure relationship. Plot point 58 indicates the bubble point of the fluid to be 1525 psi. Beyond the bubble point, the curve gets very non-linear at 60 due to the development of the vapor phase. This is confirmed by FIG. 1, which shows multi phase behavior at 1500 psi and not at 2100 psi. Thus, the prior art system did not maintain the sand face pressure above the bubble point, and the sampling was not representative of the reservoir. Clearly, the state-of-the-art was not able to control the parameters of the sampling tool satisfactorily in this instance.

For the above reasons, it would be highly desirable to have a sampling/test tool that provides improved control of the sampling/test parameters.

SUMMARY OF THE INVENTION

The invention solves the above problems as well as other problems by utilizing one or more variable force check valves in a pumping system. One or more check valves are preferably placed in a strategic location or locations in a formation pumping system. Preferably, one or more sensors are strategically placed in combination with the check valves. The sensors are preferably density sensors and pressure sensors.

In a preferred embodiment, a first variable force check valve is located between an inlet fluid suction probe at the sand face and the pump while a second variable force check valve is located between the pump and the pump system exit. Preferably, a first sensor is located between the probe and the first check valve, and a second sensor is located between the second check valve and the fluid exit. Pressure sensors are preferably located at the inlet probe, just before the first check valve, just after the second check valve, and at the outlet. The force of the check valves is preferably set so that multi-phase fluid occurs only in the suction side of the pump. Preferably, the speed of the pump is increased until multi-phase fluid also occurs on the outlet side of the pump. If the pump speed is then decreased until the multi-phase fluid just disappears on the outlet side, then maximum pumping speed is obtained. The force of the variable force check valves may be set so that the foregoing process can easily be accomplished in the particular downhole situation. For example, if in an oil zone but below the gas cap the pressure changes by three pounds per square inch (psi) for each ten feet of depth, calibration of the adjustable check valve to three psi for every ten feet below the gas oil contact allows the easy detection of two-phase flow at the outlet density sensor and easy maintenance of single-phase flow into the density sensor on the suction side. Alternatively, the force of the check valves can be controlled by a microprocessor in communication with the sensors.

The invention provides a pumping system comprising: a probe to suction a fluid from a fluid reservoir; a pump in fluid communication with the probe; a sensor to detect phase changes in the pumping system, the sensor in fluid communication with the probe or pump, the sensor generating a sensor signal; a fluid exit from the pumping system, the fluid exit being in fluid communication with the pump; and a variable force check valve located between the probe and the fluid exit. Preferably, the variable force check valve comprises a force adjustment mechanism selected from a group consisting of a hydraulic adjustment mechanism, an electronic adjustment mechanism, and a mechanical adjustment mechanism. Preferably, the system further comprises a processor for receiving the sensor signal and generating a control signal to the variable force check valve. Preferably, the variable force check valve is selected from a group consisting of: a variable force check valve located between the probe and the pump; and a variable force check valve is located between the pump and the fluid exit. Preferably, the pump is a bidirectional pump having a first piston and a second piston; and the variable force check valve comprises a first variable force check valve located between the first piston and the probe, a second variable force check valve located between the first piston and the exit, a third variable force check valve located between the second piston and the probe, and a fourth variable force check valve located between the second piston and the exit. Preferably, the system further comprises a fifth variable force check valve located between the second and fourth variable force check valves and the exit. Preferably, the sensor is located between the probe and the pump. Preferably, the sensor is located between the pump and the exit. Preferably, the sensor is selected from a group consisting of a density sensor, a bubble point sensor, a compressibility sensor, a speed of sound sensor, an ultrasonic transducer, a viscosity sensor, and an optical density sensor.

In another aspect, the invention provides a pumping system comprising: a downhole tool including a probe to suction a fluid from a fluid reservoir; a pump and a multi-phase flow detector at least partially housed in the downhole tool and in fluid communication with the probe; and a variable force check valve in fluid communication with the pump and the multi-phase flow detector. Preferably, the system further comprises a processor to receive the sensor signal and generating a control signal to the variable force check valve.

In a further aspect, the invention provides a method of controlling fluid phase in a pumping system, the method comprising: operating a pumping system to pump fluid from a formation in a reservoir at a pumping rate; sensing a phase change in the pumping system; and adjusting the pumping rate of the pump in response to the sensed phase change; wherein the controlling comprises configuring the force of a variable force check valve. Preferably, the adjusting comprises: selecting an initial pumping rate and setting the force to provide a multi-phase flow within a range of possible flows; and reducing the pumping rate until the multi-phase flow occurs only within the pumping system. Preferably, the adjusting comprises: selecting an initial pumping rate and configuring the force to provide a multi-phase flow within a range of possible flows; and adjusting the force of the variable force check valve until the multi-phase flow occurs only within the pumping system. Preferably, the pumping system has a suction side and the adjusting the force comprises adjusting the force so that the multi-phase flow occurs only on the suction side of the pump. Preferably, the sensing comprises performing a total volume analysis prior to the adjusting. Preferably, the pumping system has a suction side and the sensing comprises sensing a stable gas/liquid ratio with two-phase conditions indicated on the suction side of the pump. Preferably, the pumping system has a suction side and the force of the check valve is set so the fluid pressure is slightly above the bubble point in the suction side of the pump. Preferably, the configuring is performed prior to starting the pumping. Preferably, the pumping system comprises a probe to suction a fluid from a fluid reservoir; a pump in fluid communication with the probe; a fluid exit from the pumping system, the fluid exit being in fluid communication with the pump; the sensing comprises a sensing with a first sensor between the probe and the pump and sensing with a second sensor between the pump and the fluid exit; and detecting a fluid phase change using a time correlation method by comparing temporal traces of fluid properties sensed by the first sensor and the second sensor, the traces time-shifted to accommodate the holdup volumes in the pumping system.

The invention not only provides ease of control of the multi-phase conditions in the pump system and ease of optimization of pump speed, but also provides sampling that is closely representative of formation fluid. Numerous other advantages and features of the invention will become apparent from the following detailed description when read in conjunction with the drawings.

DETAILED DESCRIPTION OF THE PREFERRED EMBODIMENT

Figure 4:
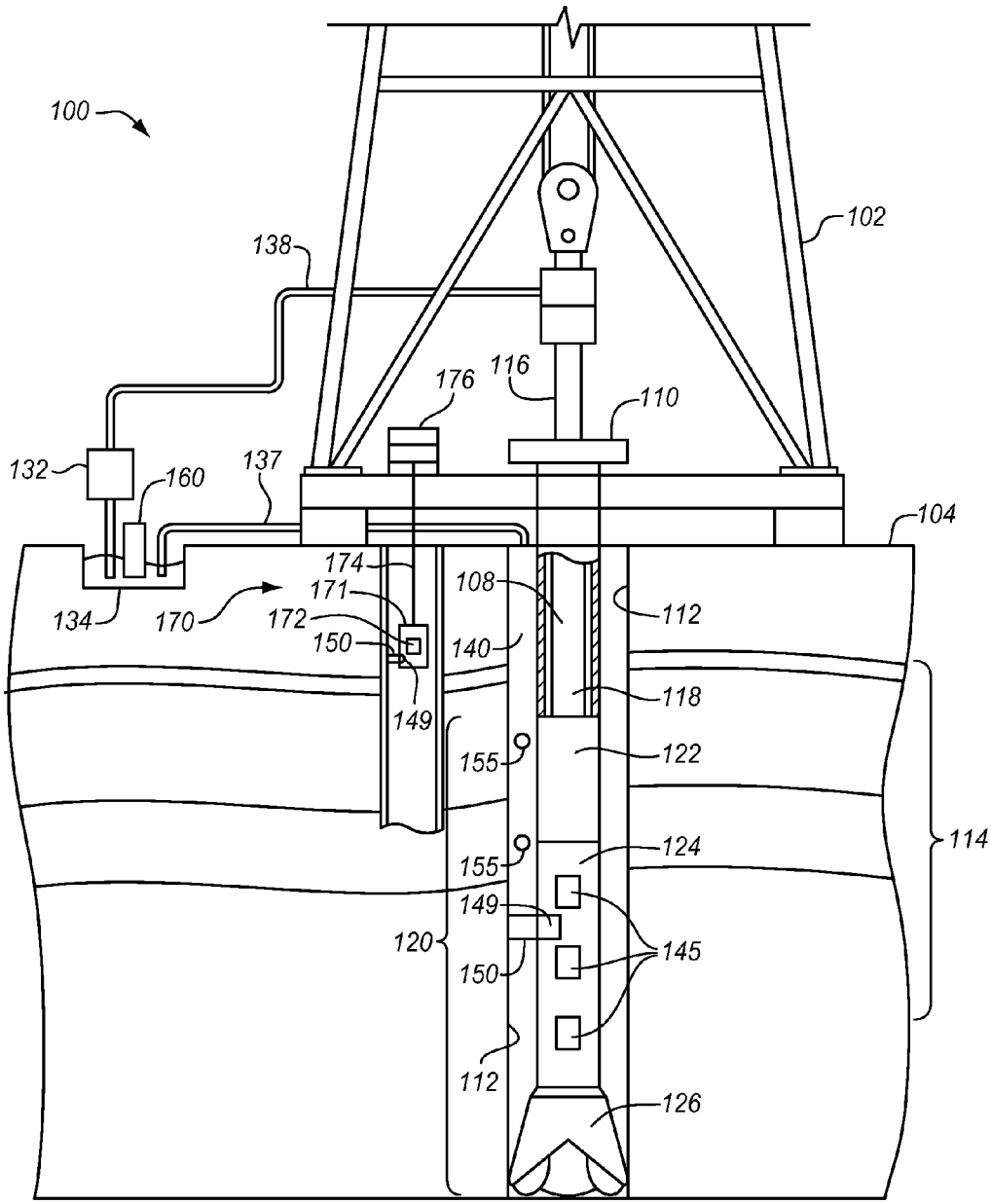
FIG. 4 illustrates a system for drilling and/or pumping operations in which check valves according to the invention may be used.
Figure 5:
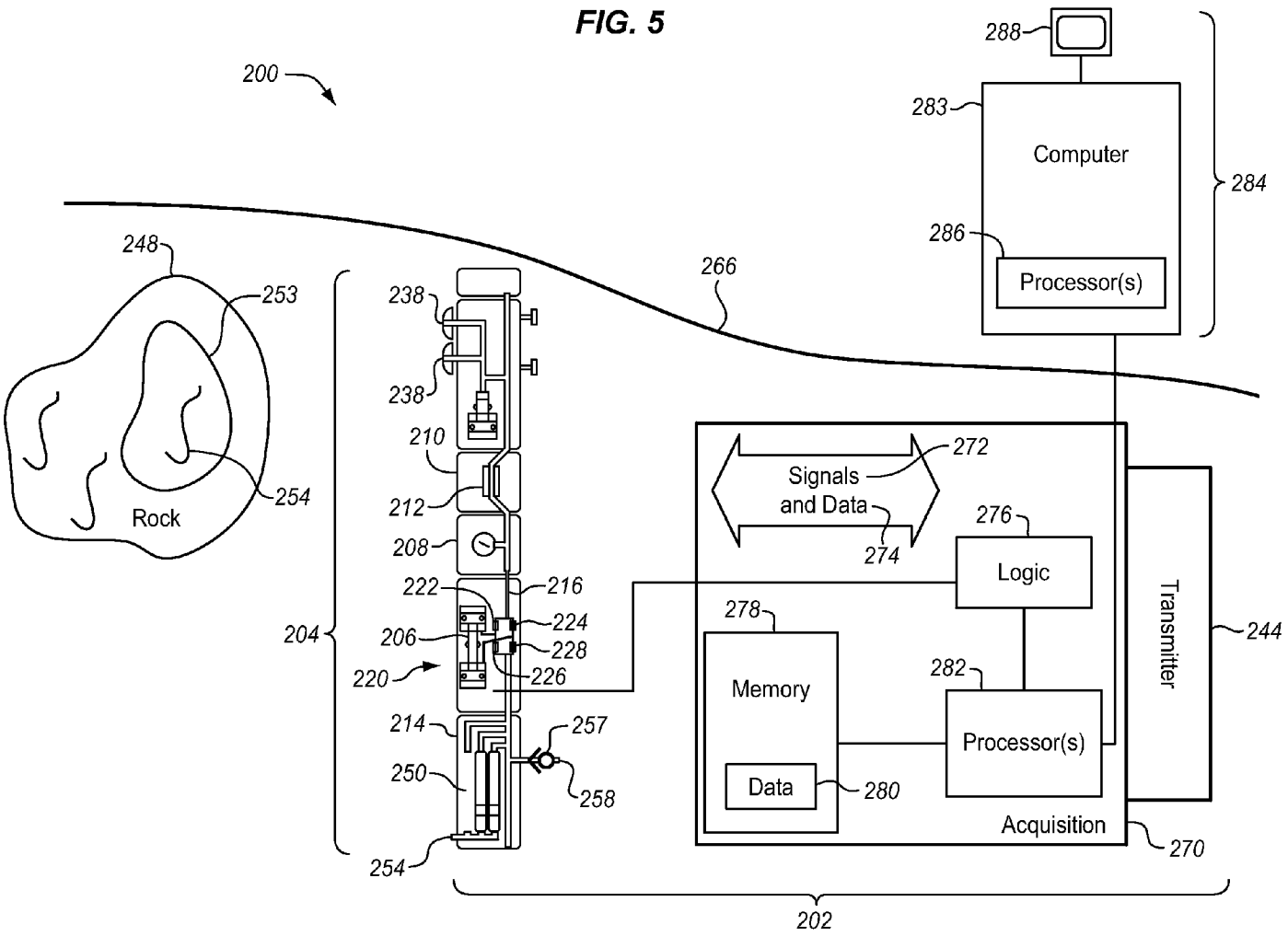
FIG. 5 is a block diagram illustrating one embodiment of a formation evaluation tool system according to the invention and the process of using the system.
Figure 6:
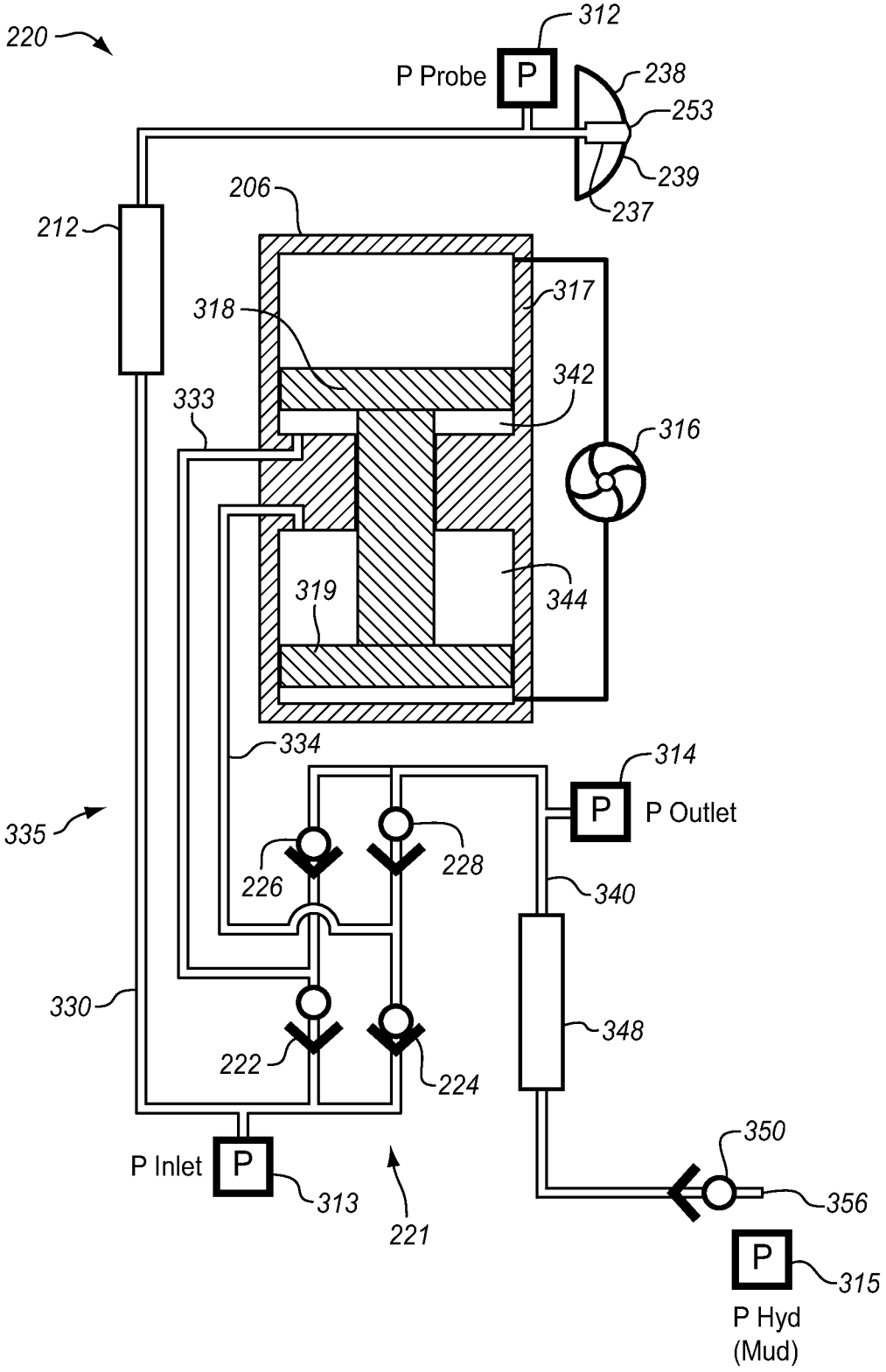
FIG. 6 is a schematic diagram of a preferred embodiment of a pumping system that may be used in the systems of FIGS. 4 and 5, showing the detailed flow path from the entry of the formation fluid to the exit of the fluid.
Figure 7:
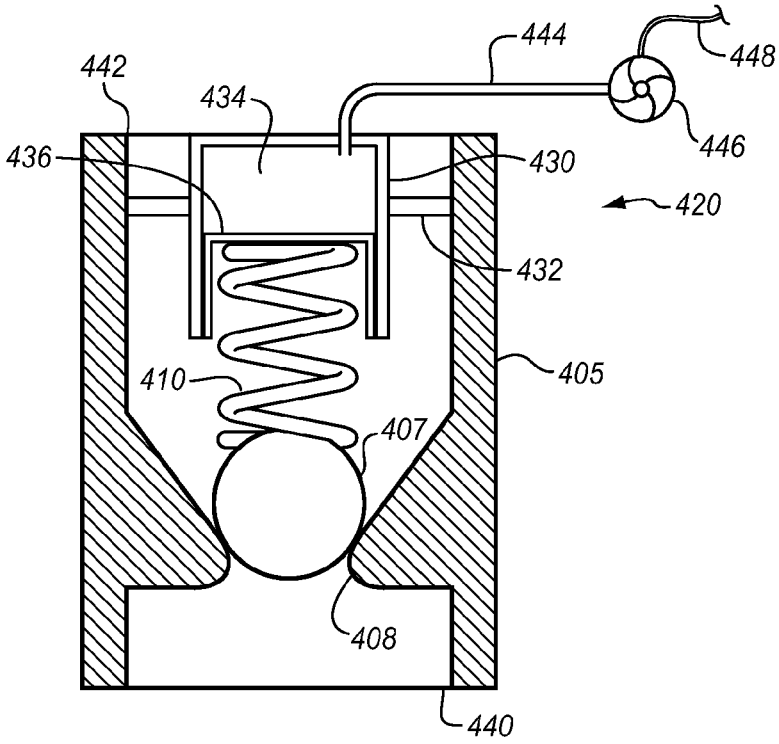
FIG. 7 is a plan diagrammatic view of a variable hydraulic check valve according to the invention showing the valve in a closed position.
Figure 8:
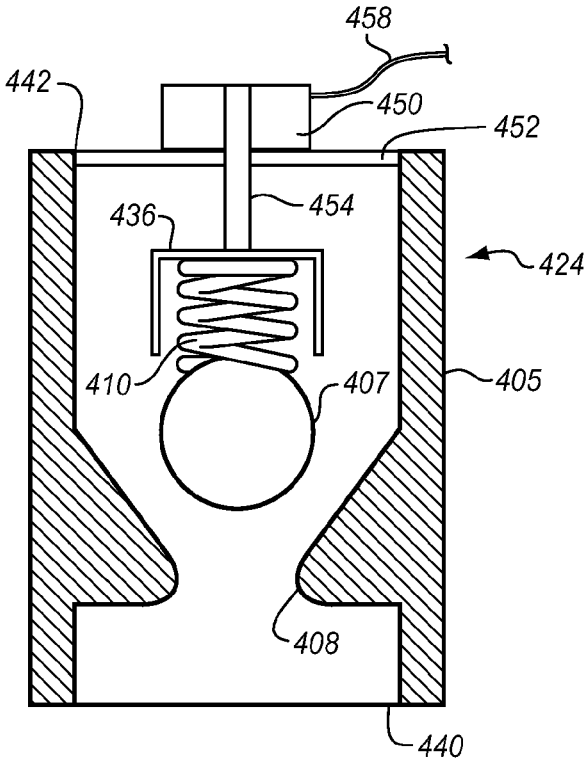
FIG. 8 is a plan diagrammatic view of a variable electrically controlled check valve according to the invention in an open position.
Figure 9:
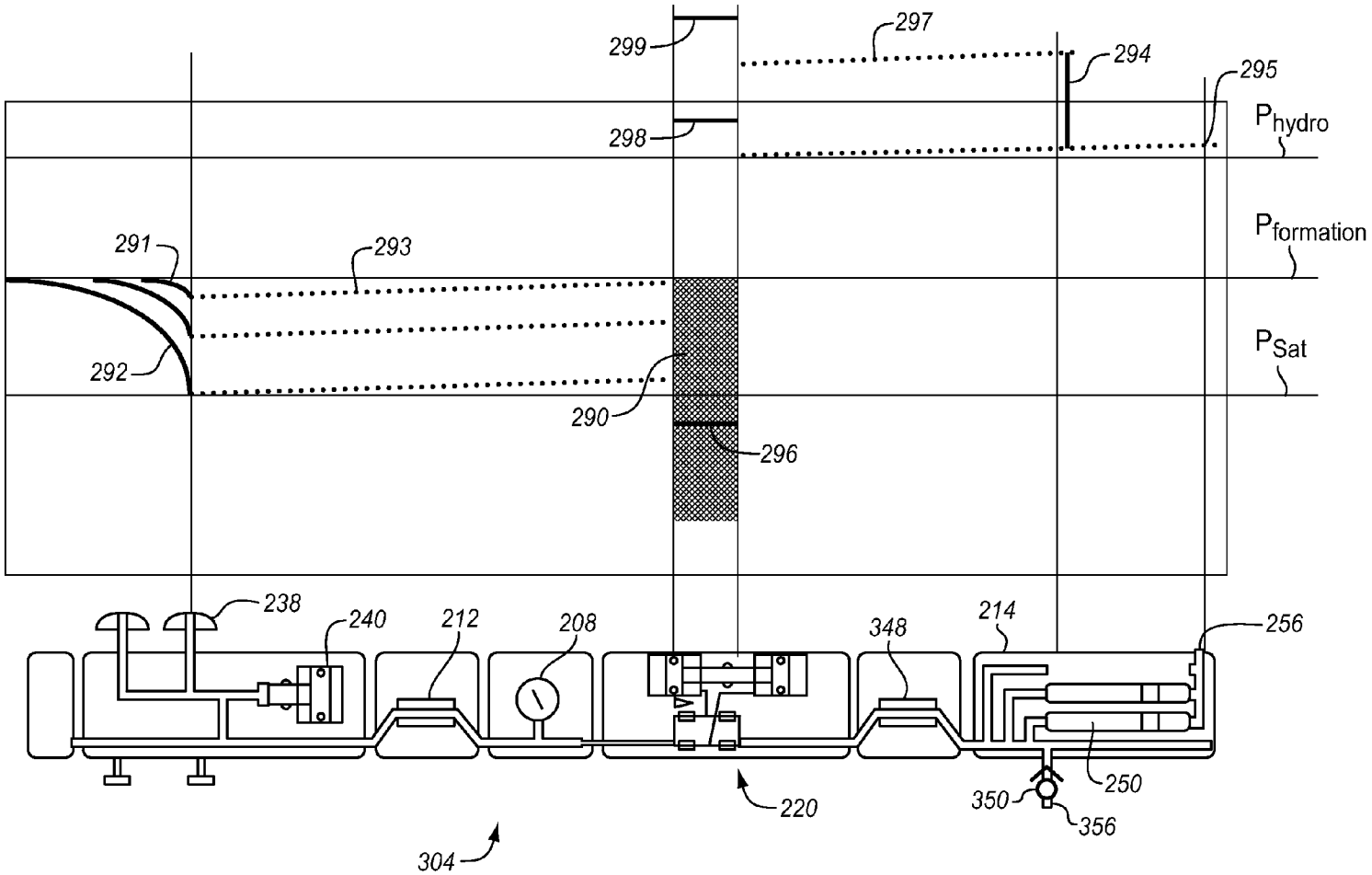
FIG. 9 is a schematic diagram of another preferred embodiment of a formation evaluation tool which may be utilized in the systems of FIG. 4 or 5 and using the pumping system of FIG. 6, with the tool placed adjacent a graph showing the pressure drop from the formation through the tool to the well annulus.

The invention relates to systems 100, 200 including a downhole tool 124, 150, 204, 205 incorporating a variable check valve 420, 424. Generalized systems according to the invention that may incorporate a downhole tool 124, 150, 204, 205 are shown in FIGS. 4 and 5 to orient the reader. Details of an exemplary tool according to the invention are shown in FIG. 5, and details of another exemplary tool according to the invention are shown in FIG. 9, along with pressure information to illustrate the use of the tool. Details of an exemplary pumping system 220, according to the invention as used in the tool of FIG. 9 are shown in FIG. 6, and examples of a check valve 420, 424 according to the invention as may be used in any of the systems are shown in FIGS. 7 and 8.

FIG. 4 illustrates a system 100 for drilling or pumping operations according to the invention. It should be noted that the system 100 can also include a system for pumping operations, or other operations. The system 100 includes a drilling rig 102 located at a surface 104 of a well. The drilling rig 102 provides support for a downhole apparatus, including a drill string 108. The drill string 108 penetrates a rotary table 110 for drilling a wellbore 112 through subsurface formations 114. Drill string 108 includes drill pipe 118, a Kelly 116 in the upper portion of drill pipe 118, and a bottom hole assembly 120 located at the lower portion of the drill pipe 118. The bottom hole assembly 120 may include drill collars 122, a downhole tool 124, and a drill bit 126. The downhole tool 124 may be any of a number of different types of tools including measurement-while-drilling (MWD) tools, logging-while-drilling (LWD) tools, etc.

During drilling operations, the drill string 108, including the Kelly 116, the drill pipe 118, and the bottom hole assembly 120, may be rotated by the rotary table 110. In addition or as an alternative to such rotation, the bottom hole assembly 120 may also be rotated by a motor that is downhole. The drill collars 122 may be used to add weight to the drill bit 126. The drill collars 122 also optionally stiffen the bottom hole assembly 120, allowing the bottom hole assembly 120 to transfer weight to the drill bit 126. Weight provided by the drill collars 122 also assists the drill bit 126 in the penetration of the surface 104 and the subsurface formations 114. During drilling operations, a mud pump 132 optionally pumps drilling fluid, for example, drilling mud, from a mud pit 134 through a hose 136 into the drill pipe 118 down to the drill bit 126. The drilling fluid can flow out from the drill bit 126 and return back to the surface through an annular area 140 between the drill pipe 118 and the sides of the borehole 112. The drilling fluid may then be returned to the mud pit 134, for example via pipe 137, and the fluid is filtered. The drilling fluid cools the drill bit 126 as well as provides for lubrication of the drill bit 126 during the drilling operation. Additionally, the drilling fluid removes the cuttings of the subsurface formations 114 created by the drill bit 126.

The downhole tool 124 may include one or more sensors 145, which monitor different downhole parameters and generate data that is stored within one or more storage mediums within the downhole tool 124. The type of downhole tool 124 and the type of sensors 145 thereon may be dependent on the type of downhole parameters being measured. Such parameters may include the downhole temperature and pressure, the various characteristics of the subsurface formations, such as resistivity, radiation, density, porosity, etc., the characteristics of the borehole, such as size, shape, etc., and other parameters.

The downhole tool 124 further includes a power source 149, such as a battery or generator. A generator could be powered either hydraulically, by the rotary power of the drill string, or other manner. The downhole tool 124 includes a formation testing tool 150, which can be powered by power source 149. In a preferred embodiment, the formation testing tool 150 is mounted on a drill collar 122. The formation testing tool 150 engages the wall of the borehole 112 and extracts a sample of the fluid in the adjacent formation via a flow line. As will be described later in greater detail, the formation testing tool 150 samples the formation and inserts a fluid sample in a sample carrier 155, or flows the fluid sample through the tool. The tool 150 may inject carrier 155 into the return mud stream that is flowing intermediate the borehole wall 112 and the drill string 108, shown as drill collars 122 in FIG. 4. The sample carrier(s) 155 flow in the return mud stream to the surface and to mud pit or reservoir 134. A carrier extraction unit 160 is provided in the reservoir 134, in a preferred embodiment. The carrier extraction unit 160 removes the carrier(s) 155 from the drilling mud.

FIG. 4 further illustrates an embodiment of a wireline system 170 that includes a downhole tool body 171 coupled to a base 176 by a logging cable 174. The logging cable 174 may include, but is not limited to, a wireline having multiple power and communication lines, a mono-cable, i.e., a cable having a single conductor, and a slick-line with no conductors for power or communications. The base 176 is positioned above ground and optionally includes support devices, communication devices, and computing devices. The tool body 171 houses a formation testing tool 150 that acquires samples from the formation. In an embodiment, the power source 149 is positioned in the tool body 171 to provide power to the formation testing tool 150. The tool body 171 may further include additional testing equipment 172. In operation, a wireline system 170 is typically sent downhole after the completion of a portion of the drilling. More specifically, the drill string 108 creates a borehole 112, the drill string is removed, and the wireline system 170 is inserted into the borehole 112.

FIG. 5 is a block diagram of an apparatus 200 according to the invention. The apparatus 200 includes a downhole tool 202, such as a pumped formation evaluation tool, comprising a fluid sampling device 204, which in turn includes a pressure measurement device 208 (e.g., pressure gauge, pressure transducer, strain gauge, etc.). The apparatus also includes a sensor section 210, which comprises a multi-phase flow detector 212.

The downhole tool 202 may comprise one or more probes 238 to touch the sand face 253 of formation 248 and to extract fluid 254 from the formation 248. The tool also comprises at least one fluid path 216 that includes a pump system 220 including pump 206. After passing through pump 206, the fluid may pass one or more sensors (see FIG. 9) and then exits the system 220. The exit may be by way or a sampling sub 214, which may be a multi-chamber section, with the ability to individually select a fluid storage module 250 through which a fluid sample can be driven to fluid exit 256 from the tool; or, as discussed in detail below, the fluid may pass out fluid exit 258 into the borehole via a variable check valve 257; or it may simply pass out the system into the borehole or to other parts of the drilling or pumping system without passing through an exit check valve. Pressure measurement device 208, sensor section 210, and other measurement devices and sensors may be located in the fluid path 216 and used to measure saturation pressure as well as other parameters as discussed in this disclosure.

The apparatus 200 may include a data acquisition system 270 coupled to the sampling device 204 and to receive signals 272 and data 274 generated by the pressure measurement device 208 and the sensor section 210. Data acquisition system 270 may include memory 278 or other machine readable medium for storing data 280, processors 282, and other logic 276. The data acquisition system 270, and any of its components, may be located downhole, perhaps in a tool housing, or at the surface 266. Apparatus 200 may also include a computer work station 284 comprising: processor(s) 286, display 288, and other computer elements 283, such as busses and memories. The logic 276 of apparatus 200 may also include a sampling control system. This and other logic may be included in tool 204, in data acquisition system 270, as part of a computer workstation 284 in a surface logging facility, or other suitable manner. Computer workstation 284 preferably contains one or more machine readable media. The logic 276 can be used to acquire formation fluid property data, such as saturation pressure, as discussed in more detail below. In some embodiments of the invention, the downhole apparatus 202 can operate to perform the functions of the workstation 284; and these results can be transmitted up hole by transmitter 244 or used to directly control the downhole sampling system. As known in the art, memory 278, other machine readable media, and machine readable media in computer work station 284 will preferably contain executable instructions for performing the methods of the invention as described below, and may also be connected or connectable to a network, such as a LAN or the Internet.

The sensor section 210 may comprise one or more sensors, including a multi-phase flow detector 212 that comprises a density sensor, a bubble point sensor, a compressibility sensor, a speed of sound sensor, an ultrasonic transducer, a viscosity sensor, a hydrogen index sensor such as a magnetic resonance sensor, and/or an optical sensor for sensing optical density or composition. It should be noted that a density sensor is often used herein as one example of a multi-phase flow detector 212, but this is for reasons of clarity and not limitation. That is, the other sensors noted above can be used in place of a density sensor, or in conjunction with it. In any case, the measurement signal(s) 272 provided by the sensor section 210 may be used as they are, or smoothed using analog and/or digital methods. In some embodiments, this same mechanism can be used with probes 238 of the focused sampling type to determine if the guard ring 239 (FIG. 7) surrounding an inner sampling probe inlet 237 is removing enough fluid to effectively shield the inner probe. A telemetry transmitter 244 may be used to transmit data obtained from the multi-phase flow detector 212 and other sensors in the sensor section 210 to the processor 282, either downhole, or at the surface 266.

FIG. 6 is a schematic diagram of a pumping system 220 in a downhole fluid sampling tool 124, 150, 204, 205, showing the flow path from the entry of the formation fluid at probe 238 to the expulsion of the fluid at 356. The pad 238 is sealed against the borehole wall allowing for formation fluid to be extracted from the formation and drawn into the flowline 330. The fluid is drawn into the tool's flowline using pump module 206 consisting of a pump housing 317 forming pump cylinders 342 and 344, pump pistons 318 and 319, and a hydraulic power source 316. Pistons 318 and 319 are cycled up and down using hydraulic flow from hydraulic source 316 allowing fluid and gas to be drawn into and out of the pump cylinder 342 via flowline 333 and in and out of pump cylinder 344 flowing through flowline 334. Check valve 222 allows fluid to flow from flowline 330 to flowline 333 when piston 318 moves upward, and check valve 226 allows fluid to flow from flowline 333 to flowline 340 when piston 318 moves downward. Check valve 224 allows fluid to flow from flowline 330 to flowline 334 when piston 319 moves downward, and check valve 228 allows fluid to flow from flowline 334 to flowline 340 when piston 319 moves upward.

As fluid is drawn into the flowline 330, it passes through the fluid ID sensor 212. Fluid ID sensor 212 can be many sensors discussed in detail above, and measures fluid before it enters the pump module 206. This sensor 212 is generally at the flowing pressure measured by pressure gauge 312 and is designated as P Probe. The pressure just before it enters the pump system 220, designated as P Inlet, is measured by gauge 313. Any pressure drop due to friction, density, viscosity, or blockages is measured by the difference in pressure from gauge 312 to the P Inlet gauge 313, which drop in pressure can be used to both understand the fluid friction coefficient as well as ensure we understand the condition of the fluid as it enters the pump module 206. Fluid ID sensor 348 can also be many sensors discussed above, and measures the fluid after it leaves the pump module 206. The pressure as it leaves pump system 220 is measured by pressure gauge 315 and is designated as P Hyd (hydrostatic). Check valve 350 controls the outflow of fluid from system 220.

FIGS. 7 and 8 are schematic plan views of exemplary variable force check valves 420 and 424 according to the invention. FIG. 7 is a plan diagrammatic view of a variable hydraulic check valve 420 according to the invention showing the valve in a closed position, and FIG. 8 is a plan diagrammatic view of a variable electrically controlled check valve 424 according to the invention in an open position. Each of the variable check valves 420 and 424 includes a valve housing 405 having an inlet port 440, an outlet port 442, and a valve seat 408. Each check valve 420 and 424 also includes a valve ball member 407, a spring 410, and a spring holder 436. Valve 420 includes a hydraulic cylinder 430 in which valve holder 436 slides, a hydraulic chamber 434, and a hydraulic fluid line 444. Hydraulic fluid line 444 is in turn connected to hydraulic 446 source, which in turn is electronically connected, wirelessly or via a wire, to either data acquisition and valve control system 270 or computer 284, or both via line 448 and associated electronic apparatus. Hydraulic cylinder support 432 supports hydraulic cylinder 430 and attaches it to valve housing 405 but does not block the port 442. Electronic valve 424 includes an electromagnetic plunger driver 450, an electromagnetic plunger 454, and an electrical cable 458 which is electronically connected, wirelessly or via a wire, to either data acquisition and valve control system 270 or computer 284. Motor support 452 supports driver 442 without blocking port 442. In each valve 420 and 424, the ball member 407 is driven downward to seat against valve seat 408 to close the valve and is released upward to open the valve. The spring 410 is driven downward or released upward to change the force which the spring exerts against ball 407. In any particular defined position, the spring has a defined force it exerts on ball 407; therefore there is a defined fluid pressure at which it will move upward to open the valve. While a ball type check valve is shown in FIGS. 7 and 8, diaphragm type valves or any other type of valve may be used. While the variable force is hydraulic in the valve of FIG. 7 and electrical in FIG. 8, mechanical or any other type of variable force may be used.

As we want to maintain the formation pressure to ensure single-phase pressure at the formation 248 and measure multi-phase behavior in pump system 220, we adjust either through selected springs or other mechanical or hydraulic measures the opening pressure of some or all of check valves 222, 224, 226, 229 and 350. As we increase the pressure required to open check valves 222 and 224, we then decrease the pressure on flowlines 333 and 334 and pump cylinder 342 and 344 as fluid is drawn into the cylinders. We monitor the fluid using fluid ID 348 and monitor for multi-phase behavior as we increase the pump rate of the fluid from the formation 348 through inlet 237 until we see the first sign of a phase change. A known pressure drop is produced across check valves 222 and 224, which pressure drop may be either calculated by applying mechanical design parameters or measured using P Inlet at gauge 313 and P Outlet at gauge 314. This known pressure drop can be used to ensure that single-phase is maintained at the sand face 253, as the pressure where multi-phase behavior occurs is pressure at the check valves 222 and 224. Valves 222 and 224 can be adjusted to produce multi-phase behavior within pump system 220 while maintaining a much higher formation pressure on sand face 253 and ensuring the margin of safety required.

This invention utilizes various combinations of suction check valves 222, 224, 226, and 228 in pump system 220, best shown in FIG. 6, to produce a method for phase detection at the exit of the pump. To flow fluid from the reservoir, pump 206 in the formation testing tool must reduce the local pressure such that it is below the reservoir pressure so that fluids can flow from the formation 248 at higher pressure into the tool 204 at a lower pressure. During a typical pump-out test operation, after the formation testing tool 204 is set against the wellbore 112, there are a set of predictable pressure drops in the flowing fluid along the flowline before the fluid is compressed to pressure that is equal to or above the hydrostatic pressure of the drilling fluid in the borehole and forced into the borehole. Some of these pressure drops are rate dependent, others are a combination of static hydraulics, and yet others are due to the mechanisms of the pumping system. The rate dependent pressure drops may be partially due to variations in formation permeability, relative permeability between formation fluids and mud filtrate, the mud, wellbore, tool interface, the viscosity flow effects within the piping of the tool, as well as the phase state of the sampled fluid, i.e., water, oil, gas, mixture, emulsions, etc. Static pressure drops may be due to changes in the density of the fluid column, its composition, and its height. In a state of steady flow, a check valve assembly 221 inside the tool acts as a final element that controls the pressure in the flowline. To provide positive sealing, the entrance check valve preferably uses a spring 410 (FIGS. 8 and 9) to provide positive pressure. As a consequence of this check valve assembly, additional pressure drop across the valve is required before fluid can enter the suction cavities 342, 344 of the pump. In this arrangement, the volume with the lowest pressure is the portion 330, 333, 334 of the flowline on the suction side of the pump. Pressure in this volume can be regulated by changing the force applied to the sealing element and by the rate at which the pump piston is withdrawn, the former being a static and the latter a dynamic component, respectively.

If the fluid in the suction side 335 of the pump is below the saturation pressure of the formation fluid, gas bubbles will form and begin to separate from the fluid. The pump continues pumping until piston reversal at the end of its stroke, at which time the segregated fluids (gas and liquid) begin to exit the pump. These fluids will remain segregated even though thermodynamically the preferred state is a single-phase, due to the fact that the separation of the phases during the suction events has generated a concentration barrier which must be overcome before the two-phase fluids can return to single-phase. The process of the segregated fluid phases returning to single-phase will take place through diffusion and mass action mixing. However, such processes occur on time scales that are longer than the cycle time of the pump. Therefore, before they can return to single-phase, the segregated phases can be detected by a sensor 348, which is a density sensor or other types of fluid property sensors, that measures various fluid properties such as viscosity, speed of sound, optical density, refractive index (RI), concentration, etc. Sensor 212 is placed in the suction line 330 to the pump between the formation and the check valves. Using sensors 212 and 348, a fluid phase change can be easily detected using a time correlation method by comparing temporal traces of fluid properties time-shifted to accommodate the holdup volumes in the fluid flowline system. Using this information, total system draw down pressure can be manipulated by changing the pump rate. The rates can be increased in the case of single-phase in and single-phase out until the multi-phase condition is detected by the outlet density sensor 348. However, under normal formation conditions, this rate is too fast to capture samples, since the fluid would be moving single-phase fluid all the way into the tool and flashing to multi-phases would be occurring at the inlet check valves 222 and 224. Once initial cleanup is accomplished, the rate should be reduced until hydrostatic (outlet) side density sensor 348 reads single-phase. A minimum of two full pump strokes will be sufficient to clear any residual saturation from the body of the pump and flowlines. Sampling can then proceed.

Figure 1:
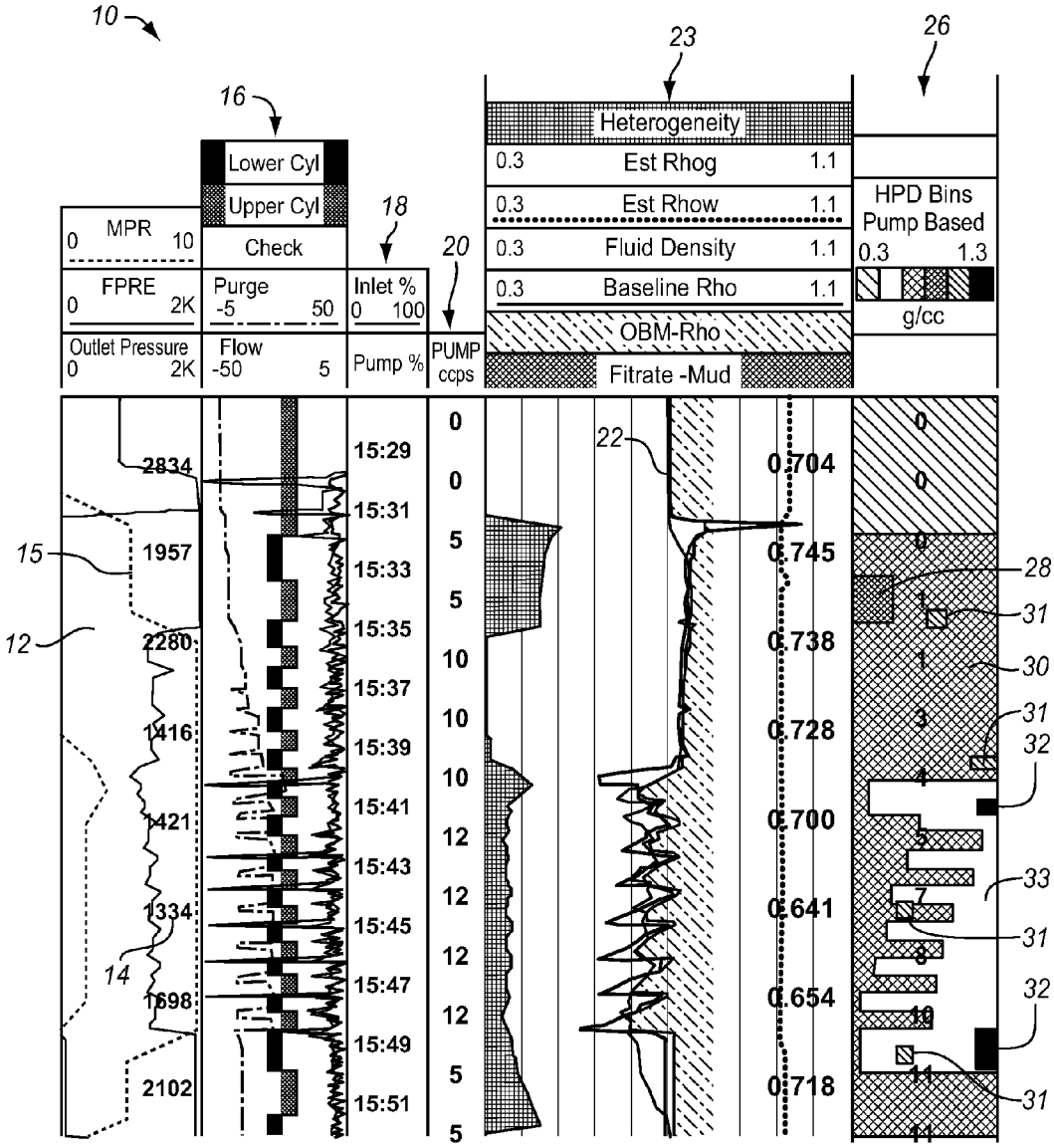
FIG. 1 PRIOR ART
FIG. 1 shows a screen of a fluid control computer displaying the output of the sensors in a prior art downhole tool.
Figure 2:
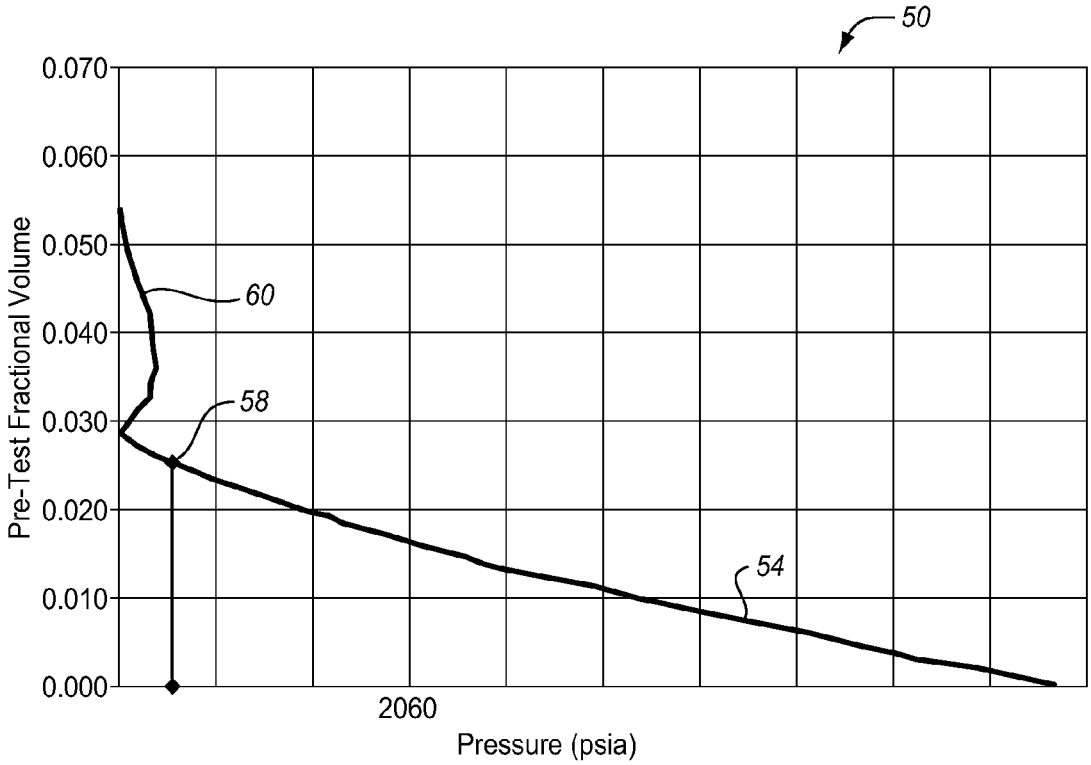
FIG. 2 PRIOR ART
FIG. 2 shows a Bubble Point plot of pressure versus pretest fractional volume of the fluid sampled in the example of FIG. 1.
Figure 3:
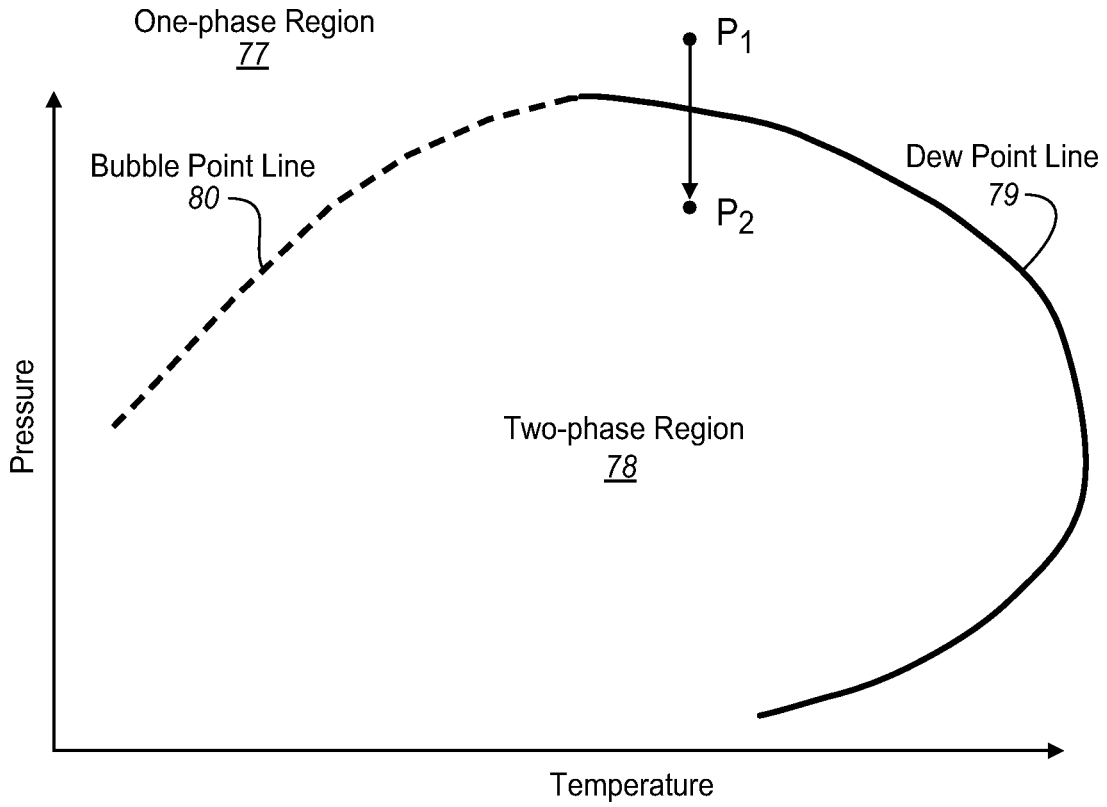
FIG. 3 shows a well-known pressure-temperature (P-T) phase diagram.

In the case where a density sensor 212 is placed between the formation 248 and the suction side 335 of the pump, the detection of multi-phase flow after initial cleanup indicates that the pump rate should be lowered. However this should wait on a total volume analysis, such as a "Multicolor Bin Plot" (MCBP) as shown in FIG. 1, which is used to interpret changing saturations in the fluid exiting the density sensor of the pump. A stable gas oil ratio with two phase conditions indicated on the suction side flow 335 indicates that the pump rate should be decreased. A changing upstream TMCBP ratio should be allowed to stabilize before attempting another interpretation, preferably after two to four strokes of the pump, or again reducing the pump rate. The optimum flow rate in these systems is achieved by maintaining the fluid pressure such that it is just slightly above the bubble point in the suction volume 335 of the pump.

A feature of the invention is that the check valve operation is controlled by a spring which has its force adjusted by a mechanical, electrical, pneumatic, or other mechanism. The spring and the operating force on the inlet check valve thus can be adjusted to any of a number of cracking pressures to suit a user's desire and need for any particular situation. For example, in an oil zone but below the gas cap by ten feet, the fluid's saturation pressure is only a few psi higher than the gas cap pressure. This situation makes the acquisition of a single-phase sample difficult. A calibration of the adjustable check valve to three psi for every ten feet below the gas oil contact allows the detection of two-phase flow at the outlet density sensor and maintenance of single-phase flow into the density sensor 212 on the suction side. This operating method achieves the user's objective of no two-phase flow in the reservoir, yet maintaining optimal pumping rate while sampling the single-phase into sample chambers.

Another example where the aforementioned method can be utilized is in the testing of a retrograde gas zone. In this case, the flow rate must be optimized to achieve the highest effective flow rate without breaking out a second phase, referred to as a retrograde condensate phase in the formation, as illustrated in FIG. 1. An adjustable force mechanism in the suction check valve may allow the selection of the pressure drop increment from zero to any desired pressure value. The actuation of the check valve can be controlled so that the difference between the formation pressure and the pump pressure is primarily a function of pump rate. In another more mechanical approach, the spring load on the check valve may be varied mechanically to adjust the required opening pressure similar to a pressure regulator or back pressure regulator.

FIG. 9 is a schematic diagram of a variation of the preferred embodiment of a formation evaluation tool 304 which may be utilized in the systems of FIG. 4 or 5 and using the pumping system of FIG. 6, with the tool 304 placed adjacent a graph showing the pressure drop from the formation at 292 through the tool to the well annulus at 295. The bottom of FIG. 9 shows one possible configuration for a preferred embodiment. The plot above the tool schematically shows possible pressure increments along the tool string. Prior to entering the probe, due to the suction at probe 238, pressure in the vicinity of the probe drops from the formation pressure $P_{formation}$ along one of lines 291-292, depending on the draw-down pressure at the probe. Line 292 represents the case where the pressure drop at the probe is just above the saturation pressure $P_{sat}$. If 292 drops below $P_{sat}$, gas will break out at the probe when entering the tool. This is undesirable in most cases. The three dotted lines, such as 293, illustrate different pressure levels that may be selected by adjustment of the force of the variable force check valves. As the fluid passes through sensors 212 and 208, the pressure rises along the lines, such as 293 and 297, as determined by the well-known formula $P=\rho gh$, where $\rho$ is the fluid density, g is the gravitational constant, and h is the height of the fluid column. Auxiliary pump 240 may be used to clear contamination or other purposes. The shaded section 290 in FIG. 9 indicates portion of the flowline inside the testing tool in which two-phase conditions are allowed and the pressure limits in this section show the range available for check valve pressure adjustment. For optimal pumping, it is sometimes desirable to maintain single-fluid-phase inside the pump 206. Line 296 represents a case where pressure inside the pump 220 has dropped below the saturation pressure $P_{sat}$. This will lead to gas breaking out in the pump and resulting in reduced pumping efficiency. After passing through the outlet check valves 226, 228, the pressure is elevated by the pressure of the pump 206. This pressure can be set between the range indicated by 294 by the exit variable check valve 350, and increases along a line, such as 297, as determined by the same well-known formula $P=\rho gh$. When a fluid sample is desired, the fluid passes sensor 348 and enters storage modules 250. Line 298 represents the required pressure in the pump 206 to overcome the hydrostatic pressure $P_{hydro}$ and the pressure increase from the pump 206 to the sample 250 chamber represented by the line 295. If the fluid is to bypass the chamber and to be pushed into the borehole, 250 will be closed and the fluid flows through check valve 350 and exits outlet 356. Line 294 represents the increase in pressure due to the outlet check valve 257. Line 299 represents the pressure inside the pump 206, which must overcome the hydrostatic pressure $H_{hydro}$, the pressure increment in the tool string represented by line 297, and the outlet check valve pressure 294 combined. As known in the art, there is other valving in system 304 directing the fluid to selected storage modules or other exit, but this is not shown for clarity. By adjustment of the pressure of the check valves and the adjustment of flow rate until phase behavior is imminent at the interface between the wellbore and the testing tool, and so two-phase behavior disappears in the region of line 297, maximum flow rate can be obtained. The induced two-phase fluid system has limits imposed by the increasing compressibility of the gaseous phase in the two-phase fluid. The limits affect both pump efficiency and pump rate. Diminishing returns in pumping rate and pumping efficiency indicate that there exists an optimum setting for maximum rate for single-phase flow before the inlet check valves 222 and 224 and maximum pump rate.

Variations from the signal output, such as a density sensor 212, 344 output that moves away from its historic average by more than one standard deviation or by some number of standard deviations, may indicate a change from a single-phase system to a multi-phase system, or from a multi-phase system to a single-phase system, particularly if the output moves in an expected direction, such as a direction indicating a phase transition from liquid to gas, or from a retrograde gas to a liquid. A control algorithm thus can be used to program the processor 282, 286 to detect multi-phase flow. The volumetric fluid flow rate of the fluid 254 that enters probes 238 as commanded by pump 206 can be reduced from some initial high level to maintain a substantially maximum flow rate at which single-phase flow can occur.

The pump 206 can be operated by the processor so that at the start of each pump stroke the flow rate is ramped up until two-phase flow is detected by the density sensor, for example by detecting the presence of large variations in output from a historic average, where the significance of the amount of variation is determined by the standard deviation of the output from the average. At that point, the pumping rate can be ramped back down until the two-phase flow indication shifts to an indication of single-phase flow. This process can be repeated for changes in pump direction, whether the pump is pushing or pulling. The pump 206 may comprise a unidirectional pump or a bidirectional pump. If the pumping rate is adjusted at the beginning of the stroke, the volume under test is minimized, providing a more sensitive measurement. In this way, the trend in onset pressures and disappearance behaviors bracket the actual saturation pressure, which can be plotted as a volume-based trend to predict the ultimate reservoir saturation pressure. Pressure and density both can be measured as the stroke continues. When a high initial pumping rate is used, multi-phase flow in the sample may occur; but as the volumetric flow rate is reduced, single-phase flow is achieved, and more efficient sampling occurs. This may operate to lower contamination in the sample, due to an average sampling pressure that is higher than what is provided by other approaches.

There has been described a novel system for controlling fluid flow in a reservoir pumping system that permits better control of the phase of the fluid, particularly within the pump, as well as many other advantages. It should be understood that the specific formulations and methods described herein are exemplary and should not be construed to limit the invention, which will be described in the claims below. Further, it is evident that those skilled in the art may now make numerous uses and modifications of the specific embodiments described without departing from the inventive concepts. As one example, the system 202 may contain alarms, displays, valving, and other features which are not shown so as not to unduly complicate the drawings and disclosure. Any of the parts of any one of the embodiments may be combined with any of the parts of any of the other embodiments. Equivalent structures and processes may be substituted for the various structures and processes described; the subprocesses of the inventive method may, in some instances, be performed in a different order; or a variety of different materials and elements may be used. Consequently, the invention is to be construed as embracing each and every novel feature and novel combination of features present in and/or possessed by the fluid phase control apparatus and methods described.

We claim:

1. A method of controlling fluid phase in a pumping system, said method comprising:

operating a pumping system to pump fluid from a formation in a reservoir at a pumping rate, wherein the pumping system comprises a probe to suction a fluid from a fluid reservoir; a pump in fluid communication with said probe; and a fluid exit from said pumping system, said fluid exit being in fluid communication with said pump;

sensing a phase change in said pumping system, wherein said sensing comprises sensing with a first sensor between said probe and said pump and sensing with a second sensor between said pump and said fluid exit, and detecting a fluid phase change using a time correlation method by comparing temporal traces of fluid properties sensed by said first sensor and said second sensor, said traces time-shifted to accommodate the holdup volumes in said pumping system; and adjusting said pumping rate of said pump in response to said sensed phase change;

wherein said controlling comprises configuring the force of a variable force check valve, said configuring comprising varying the force of said check valve utilizing a force variance mechanism other than force variability due to the Hooke's law force variation in a spring as the spring is compressed and extended during operation of said check valve and other than by mere assembly of said check valve.

2. The method as in claim 1 wherein said adjusting comprises:

selecting an initial pumping rate and setting said force to provide a multi-phase flow within a range of possible flows; and reducing said pumping rate until said multi-phase flow occurs only within said pumping system.

3. The method as in claim 2 wherein said adjusting comprises:

selecting an initial pumping rate and setting said force to provide a multi-phase flow within a range of possible flows; and adjusting the force of said variable force check valve until said multi-phase flow occurs only within said pumping system.

4. The method as in claim 3 wherein said pumping system has a suction side and said adjusting said force comprises adjusting said force so that said multi-phase flow occurs only on said suction side of said pump.

5. The method as in claim 2 wherein said sensing further comprises performing a total volume analysis prior to said adjusting.

6. The method as in claim 2 wherein said pumping system has a suction side and said sensing further comprises sensing a stable gas/liquid ratio with two phase conditions indicated on the suction side of said pump.

7. The method as in claim 2 wherein said pumping system has a suction side and said force of said check valve is set so the fluid pressure is slightly above the bubble point in said suction side of said pump.

8. The method as in claim 2 wherein said configuring is performed prior to starting said pumping.

* * * * *

UNITED STATES PATENT AND TRADEMARK OFFICE

CERTIFICATE OF CORRECTION

PATENT NO. : 8,672,026 B2
APPLICATION NO. : 12/842377
DATED : March 18, 2014
INVENTOR(S) : Anthony Herman van Zuilekom, Michael T. Pelletier and Li Gao It is certified that error appears in the above-identified patent and that said Letters Patent is hereby corrected as shown below:

Title Page, Item (54) and in the Specification, Column 1, title reads as - FLUID CONTROL IN RESERVIOR FLUID SAMPLING TOOLS - should read as - FLUID CONTROL IN RESERVOIR FLUID SAMPLING TOOLS -;

In the Specification

Column 4, line 58:
- FIG. 4 or 5 - should read as - FIGS. 4 or 5 -;

Column 11, line 3:
- FIG. 4 or 5 - should read as - FIGS. 4 or 5 -;

In the Claims

Column 14, Claim 3, line 1:
reads as - The method as in claim 2 - should read as - The method as in claim 1 -;

Column 14, Claim 5, line 1:
reads as - The method as in claim 2 - should read as - The method as in claim 1 -;

Column 14, Claim 6, line 1:
reads as - The method as in claim 2 - should read as - The method as in claim 1 -;

Column 14, Claim 7, line 1:
reads as - The method as in claim 2 - should read as - The method as in claim 1 -; and Column 14, Claim 9, line 1:
reads as - The method as in claim 2 - should read as - The method as in claim 1 -.

Signed and Sealed this
Third Day of June, 2014

Michelle K. Lee

Michelle K. Lee
*Deputy Director of the United States Patent and Trademark Office*